United States Patent [19]

Betts et al.

[11] Patent Number: 4,672,881

[45] Date of Patent: Jun. 16, 1987

[54] RECOILLESS ROCKET LAUNCHER

[75] Inventors: Robert E. Betts; Jerrold H. Arszman, both of Huntsville, Ala.

[73] Assignee: The United States of America as represented by the Secretary of the Army, Washington, D.C.

[21] Appl. No.: 891,717

[22] Filed: Jul. 28, 1986

[51] Int. Cl.[4] ..... F41F 3/045

[52] U.S. Cl. ..... 89/1.816; 89/1.815; 89/1.7

[58] Field of Search ..... 89/1.816, 1.815, 1.8, 89/1.819, 1.7, 1.813, 44.02, 44.01

[56] References Cited

U.S. PATENT DOCUMENTS

| | | | |
|---|---|---|---|
| 2,941,448 | 6/1960 | Brandt | 89/1.813 |
| 2,956,478 | 10/1960 | Ream et al. | 89/1.815 |
| 3,011,407 | 12/1961 | Van Koningsveld | 89/1.7 X |
| 3,030,865 | 4/1962 | Ridnour | 89/1.816 |
| 3,490,330 | 1/1970 | Walther | 89/1.7 |
| 3,501,997 | 3/1970 | Winsen et al. | 89/44.02 |
| 3,662,648 | 5/1972 | Maillard | 89/44.01 X |
| 3,672,255 | 6/1972 | Findlay et al. | 89/1.7 X |

*Primary Examiner*—David H. Brown

*Attorney, Agent, or Firm*—John C. Garvin, Jr.; Freddie M. Bush

[57] ABSTRACT

A recoilless rocket launcher including a rocket launch tube which is resiliently coupled to a support member. Points of contact to the gunner who fires the rocket from a rocket launch tube are to the shoulder and the hand which grips a hand grip which is part of the firing mechanism integrally attached to the support member. The resilient coupling for support member is comprised of a resilient material selected from the group consisting of a butene-diolefin copolymer, rubber, plastic, leather, or fiberous paper. The resilient material disposed in spaced relation adjacent opposite ends of the support member resiliently couples the support member to the launch tube. The nonrigid coupling effects the transfer mechanisms to result in a time offset, extended reaction time, and a reduced total impressed impulse transferable to the gunner prior to rocket exiting the rocket launch tube. This described action is accomplished by the resilient coupling, and in an advanced embodiment, sliding means to allow the rocket launch tube to freely slide in the support member also permits a significant delay and a reduction in the forces that can be transferred directly to the gunner to thereby derive benefits including improved personal comfort to the gunner, enhancement of confidence level in system, and a significant improvement in the expected accuracy of the rocket launched to a target from a shoulder fired rocket launcher.

8 Claims, 6 Drawing Figures

RECOILLESS ROCKET LAUNCHER

DEDICATORY CLAUSE

The invention described herein may be manufactured, used, and licensed by or for the Government for governmental purposes without the payment to us of any royalties thereon.

BACKGROUND OF THE INVENTION

The short duration recoil forces which takes place at the interface of a gunner and the launch tube of a shoulder fired rocket are evident even on rocket launch tubes which are designated as being recoilless. These short duration recoil forces that vary in magnitude and direction include detent release, gas drag, and friction. If the gunner is in direct contact with the launch tube at the time these forces are present, it follows that the accuracy of the rocket launching can be impaired as further described hereinbelow.

For a normal recoil system, the impairment to accuracy begins when the action first starts during a microsecond time period that a force is applied to a gunner and is intergrated with time. The gradually changing instantaneous force on the gunner causes a torque or twisting action to take place, changing to some degree the muzzle position before the projectile leaves the launcher.

In order for a recoilless rocket launcher to achieve a marked improvement over existing prior art launchers, the design of the shock absorbing means must reduce the total reactant forces to the gunner, and additionally offset the start time of reaction of these forces.

Therefore, the primary object of this invention is to improve the accuracy of a rocket launched from a recoilless rocket launcher by design features which permit the rocket to exit the launch tube before any angular movement of the launch tube is permitted.

Another object of this invention is to reduce the effects of forces on the gunner by design features which reduce the peak forces by spreading the time of applied forces to thereby achieve the desired effect to the gunner.

A further object of this invention is to allow the positive and negative recoil forces to add together and reduce the resultant force before such force is transferred to the gunner.

These and other objects of this invention will evolve to those skilled in the art from reviewing the complete specification of this invention set forth herein.

SUMMARY OF THE INVENTION

The recoilless rocket launcher of this invention provides the means to minimize the recoil effects by eliminating the direct coupling of the gunner to the launch tube. When the gunner is in direct contact with the launch tube at the same time such short time forces, e.g., detent release, gas drag, and friction, come into play, the accuracy of the rocket launching is impaired.

The recoilless rocket launcher has a launch tube that is placed on a support. This support is directly coupled to the gunner. Coupling of the support to the launch tube is made through a flexible joint or is not coupled at all but is allowed to float freely because of structural support design means whereby the launch tube and support means can move independently during the launching procedure.

DESCRIPTION OF THE PREFERRED EMBODIMENTS

Figure 1:
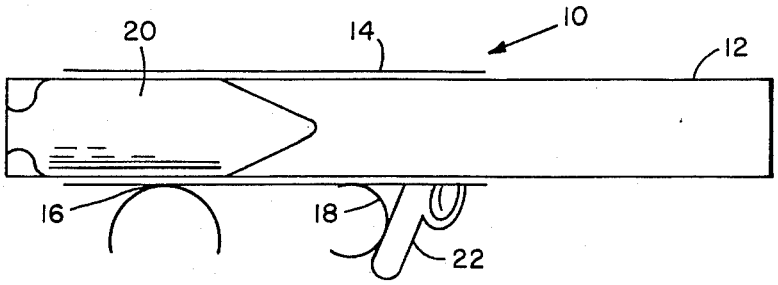
FIG. 1 of the drawing shows schematically a rocket launcher with the support and gunner contact points; and, FIGS. 2–6 show various coupling means between the support member and rocket launch tube.
Figure 2:
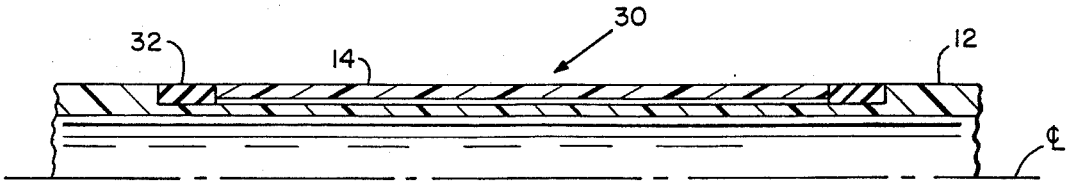
Figure 3:
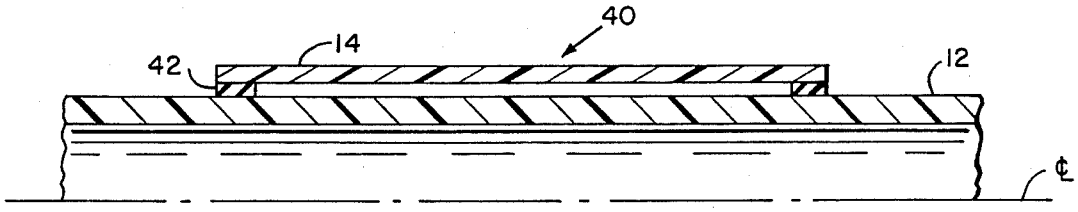
Figure 4:
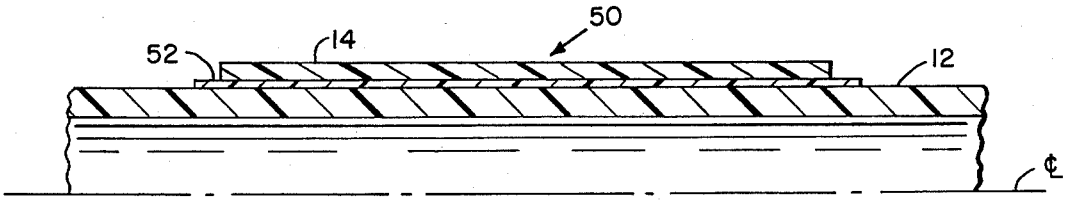

In further reference to the drawing, FIG. 1 depicts a recoilless rocket launcher 10 comprised of a launch tube 12 and a support member 14 for the launch tube. Connections between the support member 14 and launch tube 12 are not rigid, but are flexible; however, the separation between the support member and the launch tube as illustrated in FIG. 1 merely depicts the non-rigid support means separately illustrated in FIGS. 2 through 6 in detail. Since the support member 14 is freely movable independently of the launch tube 12 the gunner contact points 16 (shoulder) and 18 (hand), the short time forces such as detent release, gas drag, and friction related to launching are not transferred from the launch tube to the support member, via the contact points 16 and 18 respectively, prior to the rocket exiting the launch tube, and then the peak forces are transferred only at a minimum level or not noticeably transferred at all since the sum of these positive and negative forces is less than the magnitude of the highest force. FIG. 1 also illustrates a rocket 20 positioned within the launch tube 12 and a handle or firing mechanism 22 is shown attached to the support member. Gunner contact points 16 and 18, although in close proximity to firing mechanism 22, do not transfer peak forces to the gunner because of the non-rigid connection between the support member and the launch tube. Transfer of peak forces to the gunner because of the prior art rigid connection relationship between the support and launch tube can impair the accuracy of the rocket launching. How the accuracy of the rocket launching is improved and how the design structures contribute to this accuracy will be better appreciated after the reviewing and the understanding of the following detailed description of the various embodiments depicted in the drawing, FIGS. 2–6.

In reviewing the forces exerted by the rocket of FIG. 1, as the rocket moves forward the forces on the launch tube are rocket-to-launch-tube friction which is forward, and gas-flow-to-launch-tube which is rearward. Any instantaneous unbalance of these forces would result in a movement of the rocket-launch-tube-gunner combination if the tube were in direct contact with gunner. By allowing the launch tube to be held by a support member then the resultant force transmitted to the gunner is through what ever frictional forces there are between the support member and launch tube. A launch tube suspended freely in the support member would approach zero friction.

The flexible coupling attachment between the launch tube and support member would always have reactive forces less than a direct coupling of launcher to gunner.

As illustrated in FIGS. 2–5, a flexible or resilient material 32, 42, 52, and 62 selected from Flexon (e.g., a butene-diolefin copolymer), rubber, plastic, leather, or fiberous paper, is shown in a flexible coupling relationship between and in intimate contact with the launch tube and support member, illustrated respectively as systems references 30, 40, 50, and 60 in FIGS. 2–5. The resilient coupling member of systems 30, 40, 50, and 60 are shown disposed in spaced relationship, adjacent opposite ends of the support member. The resilient coupling of system 50 is shown positioned continuous along the length of the support member. In operation the described forces between the launch tube and support member are delayed and reduced by the resilient coupling so that the only forces transmitted to the gunner is through whatever frictional forces that are between the support member and launch tube. Also the launch tube held by a support member with a flexible material therebetween is essentially a floating launch tube where only linear movement of a reduced amount can take place with no angular movement being permitted to take place. As illustrated in FIGS. 2–5, the flexible coupling are continuously attached at preselected discontinous points between the support and launch tube.

Figure 5:
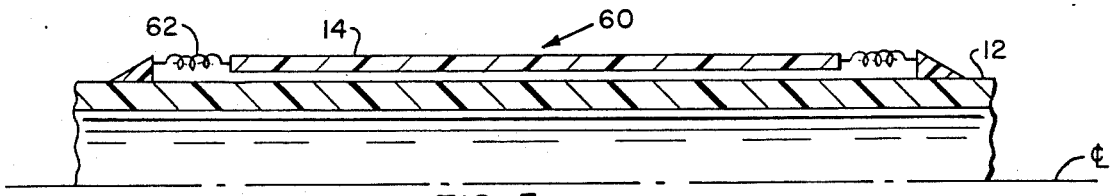

A further, extension of the recoilless system of this invention is illustrated in FIG. 5 wherein the launch tube is slid inside the support with space being maintained between the coupling, i.e., springs, Flexons etc, and the launch tube. After the tube slides a given distance the couplers are connected. This action delays even further any reaction time to the gunner.

Figure 6:
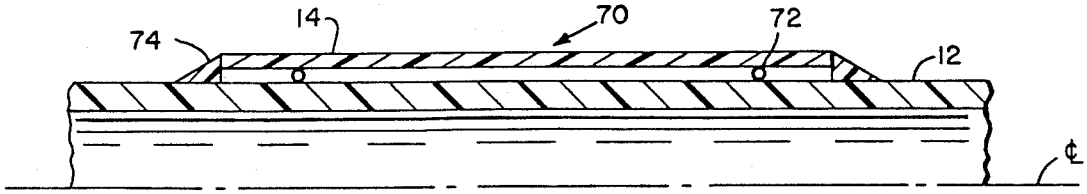

As further illustrated in FIG. 6 the system 70 includes resilient stops 74 and roller bearings 72. Stops are removed prior to launch to allow support and launch tube to move freely thereby reducing the effects of forces which can be transmitted to the gunner.

The preceeding description of the recoilless rocket launcher of this invention provides the cooperative relatioship between its elements and the functions thereof to achieve the desired results. The additional description to follow is intended to provide further teachings to impart a better understanding of the invention in use.

The operation of this invention can reduce the interaction between the man and the machine through various transfer mechanisms as illustrated in the drawing, described hereinabove, and as further described hereinbelow.

These transfer mechanisms can result in a time offset, extended reaction time, and reduced total impressed impulse.

The time of the force transfer to the gunner can be offset by allowing the launch tube to move in relative freedom so that significant forces are not immediately transferred to the gunner. This can be accomplished by a very resilient coupler or by a launch tube sliding freely in a support, e.g., as shown by FIGS. 1–6.

The extended reaction time is achieved through the flexible joint. The actual recoil forces may be imparted to the launch tube over a very short period of time. By using a coupling between the launch tube and the gunner, the timeline of the force transmitted to the gunner is extended based on the mechanics and resiliency of the coupler. The movement of the launch tube will be initially transferred to the coupler which will transmit some of the impressed force immediately, but the coupler will store energy based on its mechanics and resiliency. The stored portion of the energy will then be released after the impressed force begins to decay. The effect on the gunner will be to apply the same total impulse, but the force will be lower over a longer period of time. This change will be beneficial to the gunner in that a lower force over a longer time is more easily absorbed and controlled by a gunner.

Reduced total impulse impressed on the gunner can be achieved since the recoil forces on the launch tube can many times contain both positive and negative peaks. Theoretically, a gunner can perceive a recoil force from one of the peaks even though the summation of the force-time product (total impulse) may be zero. Through this invention, the recoil forces are indirectly coupled to the gunner, and the peak forces are not transferred directly to the gunner. Therefore in summation, the effect on the gunner is more related to the total impulse which can be significantly reduced for recoil forces where both positive and negative forces are present. The total benefits of the recoilless rocket launcher of this invention include both personal comfort to gunner, enhancement of confidence level in system, and a significant improvement in the expected accuracy of the rocket launched to a target from a shoulder fired rocket launcher.

We claim:

1. A recoilless rocket launcher comprising a rocket launch tube adapted for receiving and launching a rocket from a shoulder firing position of a gunner; a support member for said rocket launch tube; and resilient means positioned between said support member and said rocket launch tube and in intimate contact with both said support member and said rocket launch tube for resiliently coupling said support member to said rocket launch tube to permit relative freedom of movement of said rocket launch tube and said support member, said support member including a firing mechanism as an integral part thereof in the form of a hand grip member which enables the gunner to fire said rocket from a shoulder held position whereby one point of contact of said support member is with the hand of the gunner and another point of contact of said support member is with the shoulder of the gunner, said resiliently coupled support member effective in achieving an offset of time of transfer mechanism and reduced total impressed forces transferred between said rocket launch tube and said point of contact with the gunner to permit said rocket to exit said rocket launch tube prior to the transfer of any of said impressed forces to gunner and as a result of said offset of time and said reduced total impressed forces transferred to said gunner an improvement in accuracy of launching said rocket to a target is achieved.

2. The recoilless rocket launcher of claim 1 wherein said resilient coupling is in the form of a plurality of springs, said springs being disposed in spaced relation, adjacent opposite ends of said support member to thereby suspend said support member in a spaced apart relationship with said rocket launch tube.

3. The recoilless rocket launcher of claim 1 wherein said intimate contact of said resilient means is along the entire length of said support member.

4. The recoilless rocket launcher of claim 1 wherein said resilient coupling is disposed in spaced relation, adjacent opposite ends of said support member.

5. The recoilless rocket launcher of claim 2 wherein said resilient coupling is axially aligned with said support member.

6. The recoilless rocket launcher of claim 5 wherein said resilient coupling is fabricated from a resilient material selected from the group consisting of a butene-diolefin copolymer, rubber, plastic, leather, or fiberous paper.

7. A recoilless rocket launcher comprising a rocket launch tube adapted for receiving and launching a rocket from a shoulder firing position of a gunner; a support member for said rocket launch tube; removable, resilient stops for retaining said support member in a relatively secured position with respect to said rocket launch tube until said resilient stops are removed; and means positioned between said support member and said rocket launch tube and in intimate contact with both said support member and said rocket launch tube for achieving sliding action to permit said rocket launch tube to slide within said support member, said support member including a firing mechanism as an integral part thereof in the form of a hand grip member which enables the gunner to fire said rocket from a shoulder held position whereby one point of contact of said support member is with the hand of the gunner and another point of contact of said support member is with the shoulder of the gunner, said removable, resilient stops in the combination with said means for achieving sliding action are effective in achieving an offset of time of transfer mechanism and reduced total impressed forces transferred between said rocket launch tube and said point of contact with the gunner to permit said rocket to exit said rocket launch tube prior to the transfer of any of said impressed forces to gunner and as a result of said offset of time and said reduced total impressed forces transferred to said gunner an improvement in accuracy of launching said rocket to a target is achieved.

8. The recoilless rocket launcher of claim 7 wherein said means to achieve sliding action is in the form of plurality of roller bearings positioned between said support and said rocket launch tube and wherein additional sliding action is achievable following release of said resilient stops prior to launch which enables said support and said rocket launch tube to move more freely relative to each other.

* * * * *